US007685889B2

(12) United States Patent
Hsieh

(10) Patent No.: US 7,685,889 B2
(45) Date of Patent: Mar. 30, 2010

(54) MULTI-FUNCTION DIGITAL TOOL

(75) Inventor: Chih-Ching Hsieh, P.O. Box 70-121 Taichung, Taichung City (TW) 40899

(73) Assignee: Chih-Ching Hsieh, Taichung County (TW)

( * ) Notice: Subject to any disclaimer, the term of this patent is extended or adjusted under 35 U.S.C. 154(b) by 0 days.

(21) Appl. No.: 12/013,476

(22) Filed: Jan. 14, 2008

(65) Prior Publication Data

US 2009/0178519 A1 Jul. 16, 2009

(51) Int. Cl.
*B25B 23/14* (2006.01)

(52) U.S. Cl. ..... 73/862.22

(58) Field of Classification Search ..... 73/862.22
See application file for complete search history.

(56) References Cited

U.S. PATENT DOCUMENTS

| | | | | |
|---|---|---|---|---|
| 4,958,541 | A * | 9/1990 | Annis et al. | 81/479 |
| 6,981,436 | B2 * | 1/2006 | Becker et al. | 81/479 |
| 7,096,747 | B1 * | 8/2006 | Hsieh | 73/862.22 |
| 7,107,884 | B2 * | 9/2006 | Cutler et al. | 81/479 |
| 7,370,539 | B2 * | 5/2008 | Gharib et al. | 73/862.21 |
| 2007/0119267 | A1 * | 5/2007 | Anjanappa et al. | 73/862.21 |
| 2007/0230154 | A1 * | 10/2007 | Nakayama | 361/810 |

* cited by examiner

*Primary Examiner*—Lisa M Caputo
*Assistant Examiner*—Octavia Davis
(74) *Attorney, Agent, or Firm*—CKC & Partners Co., Ltd.

(57) ABSTRACT

A multi-function digital tool includes a body portion positioned between a handle portion and a driving portion; said driving portion having a driving head; a space provided for installing a electronic mechanism inside said body portion; and a volume provided for installing at least two electronic units with tiering inside said electronic mechanism.

7 Claims, 5 Drawing Sheets

MULTI-FUNCTION DIGITAL TOOL

FIELD OF THE INVENTION

The present invention relates to the multi-function digital tool, and particularly to a digital tool with tiering electronic unit for minimizing the volume of the electronic mechanism and providing various functions.

BACKGROUND OF THE INVENTION

In the past, people always use the hand tool by feeling, there is no data to make sure the power while using the hand tool is suitable or not. It always causes over-power or insufficient-power and that will damage the safety. For example, the wrench provides torsion power for different purpose of use. While using the wrench for the purpose of tightening a fastener, different people use different power to produce different torsion values to tighten. So the tightening force of the fastener will be totally different.

U.S. Pat. No. 6,968,759 discloses the typical electronic torque wrench comprising inner and outer telescoping housing portions and a battery tray assembly telescopically receivable in the inner housing portion and a bezel assembly receivable in an aperture in the outer housing portion and interconnected with the housing portions and the battery support assembly by a single fastener. The bezel assembly carries torque measuring circuitry including a microcontroller, and a four-key pad including arrow keys for incrementing and decrementing a preset torque level at any time, an on/zero key and a units key for toggling among plural different units of torque measurement. The preset torque level is displayed until torque is applied or a key is pressed and can be changed and displayed at anytime.

However, those prior arts providing the display of torsion value, but with technology developing, the need of functions of the electronic torque wrench is also increasing, so that using the space inside of the electronic wrench efficiently is more important; especially the length of electronic wrench is limited by the size of the working place, the width of electronic wrench is limited by the size of people's hand. So the electronic mechanism only can be installed in the depth of the electronic wrench. Thus there is an eager demand for a novel design which can improve the defect in the prior art.

SUMMARY OF THE INVENTION

Accordingly, the primary object of the present invention is to provide various functions, and using the space inside of the tool efficiently.

To achieve the above objectives, the present invention provides a digital tool for measuring. The tool includes a body portion positioned between a handle portion and a driving portion, the driving portion having a driving head; a space positioned inside the body portion for installing a electronic mechanism, a display unit installing on the outer surface of the electronic mechanism, a volume positioned inside the electronic mechanism, at least two electronic units installed in the volume with tiering, and wherein the electronic unit is PCB or FPCB, a controlling unit is installed on the outer surface of the electronic unit.

The volume inside the electronic mechanism of the present invention has the electronic units with tiering. It is efficient to minimize the volume of electronic mechanism inside the body portion. The electronic units of different function can also package into the same electronic mechanism for providing various functions in the same tool, and the electronic unit can be the flexible printed circuit board with folding for preventing from damage or crash.

The various objectives and advantages of the present invention will be more readily understood from the following detailed description when read in conjunction with the appended drawing.

DETAILED DESCRIPTION OF THE INVENTION

In order that those skilled in the art can further understand the present invention, a description will be provided in details below. However, these descriptions and the appended drawings are only used for those skilled in the art to understand the objects, features, and characteristics of the present invention, but not to be used to confine the scope and spirit of the present invention defined in the appended claims.

Figure 2:
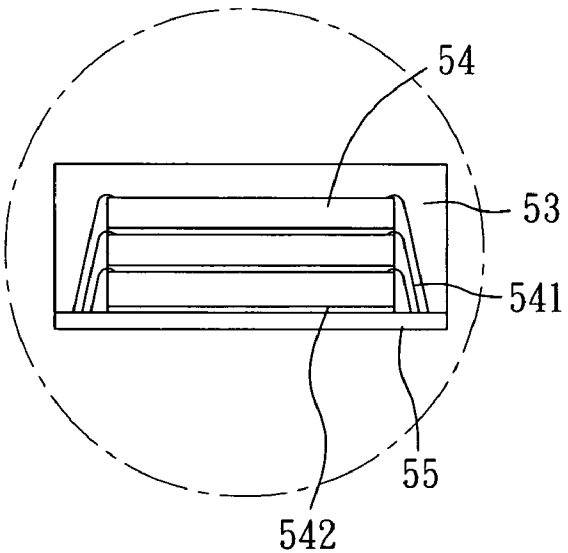
FIG. 2 shows the cross-sectional view of the A-A' line of FIG. 1.
Figure 1:
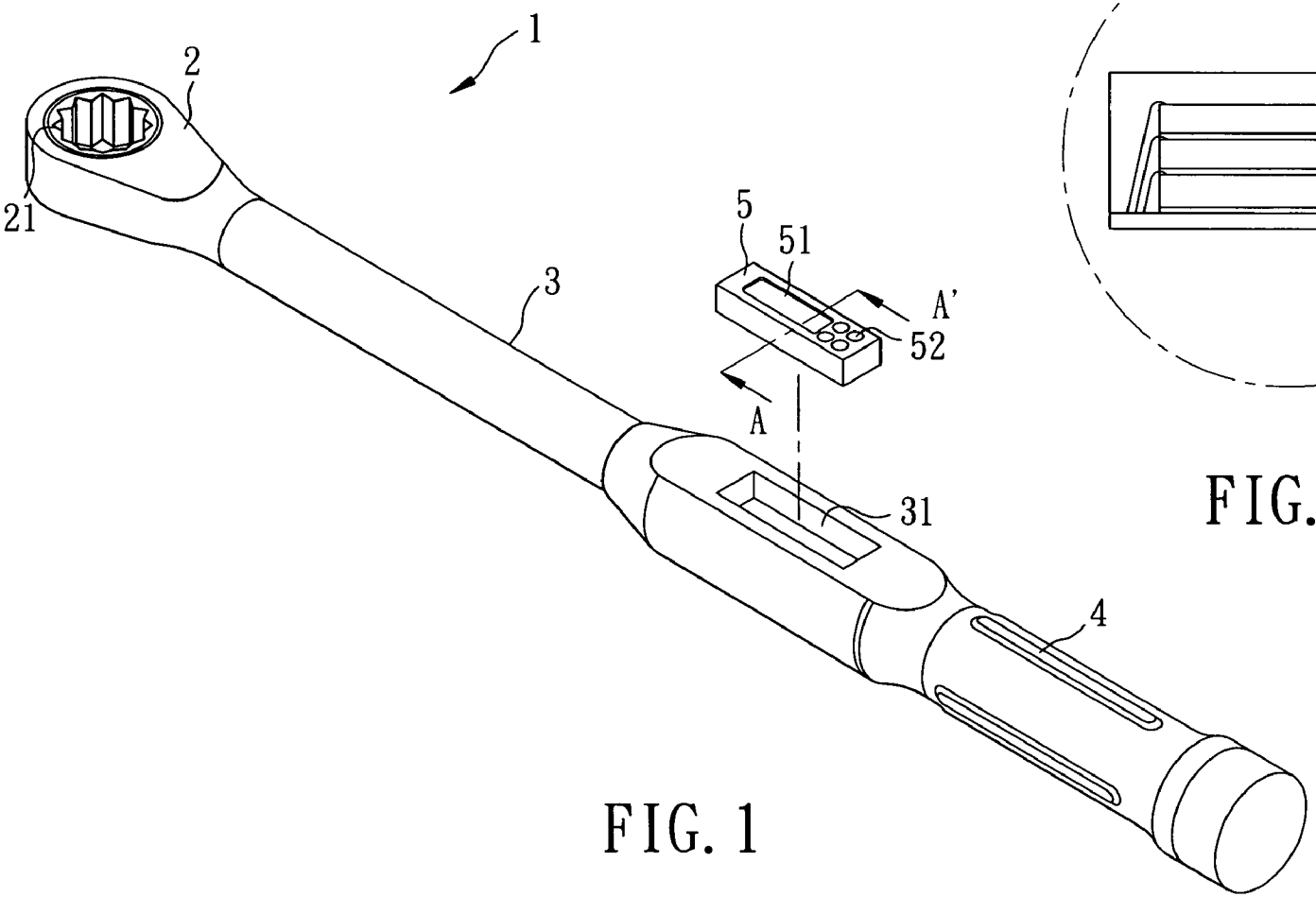
FIG. 1 is a schematic explode view of the first embodiment of the present invention.

Referring the first embodiment of FIG. 1, a multi-function digital tool according to the present invention is illustrated. The tool 1 of the present invention has the following elements:

a driving portion 2 has a driving head 21 for driving nuts; the driving head 21 can be a ratchet wrench, or a driving-socket wrench, or a open-end wrench, or a box-end wrench;

a handle portion 4 has a adequately length for holding;

a body portion 3 is positioned between the driving portion 2 and the handle portion 4;

a space 31 is positioned in the concave of the body portion 4 for installing a electronic mechanism 5; a display unit 51 is installed on the outer surface of the electronic mechanism 5 for providing setting or viewing values; at least one controlling unit 52 is installed on the outer surface of the electronic mechanism 5 for setting or inputting the default values;

a volume 53 is positioned inside the electronic mechanism 5 for installing at least two layers of electronic unit 54 with tiering; the electronic units 54 can be PCB (printed circuit board) or FPCB (flexible printed circuit board);

As FIG. 2 shows, there is a isolated layer 542 installing in and between the electronic units 54 with three-layers-tiering of the first embodiment of the present invention for preventing from short-circuit, and outside of the electronic unit 54 has bond wires 541 for connecting electronically to a substrate 55 in the bottom.

Figure 3:
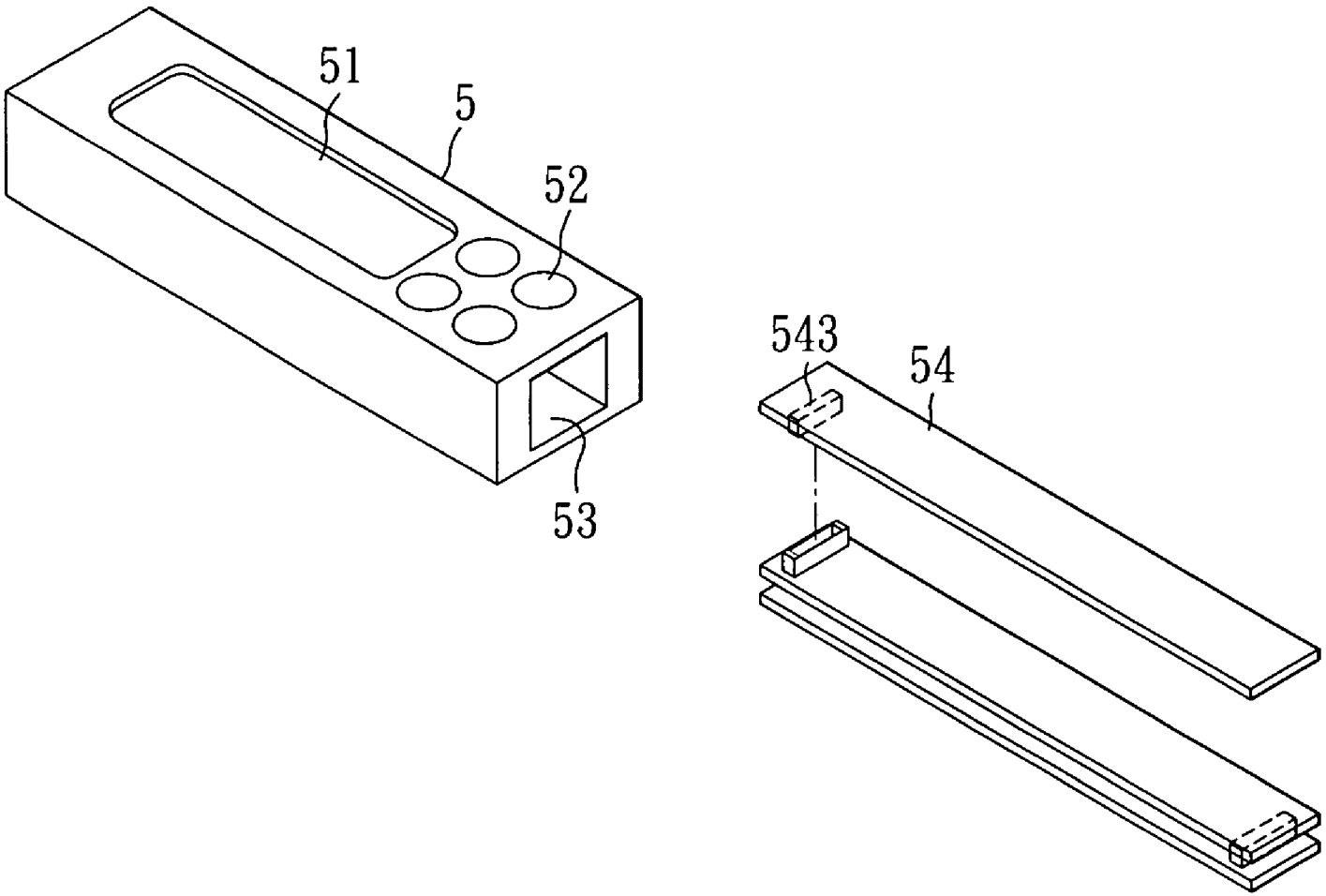
FIG. 3 is a schematic explode view of the second embodiment of the present invention.

FIG. 3 shows the second embodiment of the present invention, the volume 53 is positioned inside the electronic mechanism 5 for installing layers of electronic unit 54; the electronic units 54 with chip-like structure have pins 543 for connecting electronically to each other with parallel tiering. So it is efficient to minimize the volume of the electronic mechanism 5.

Figure 4:
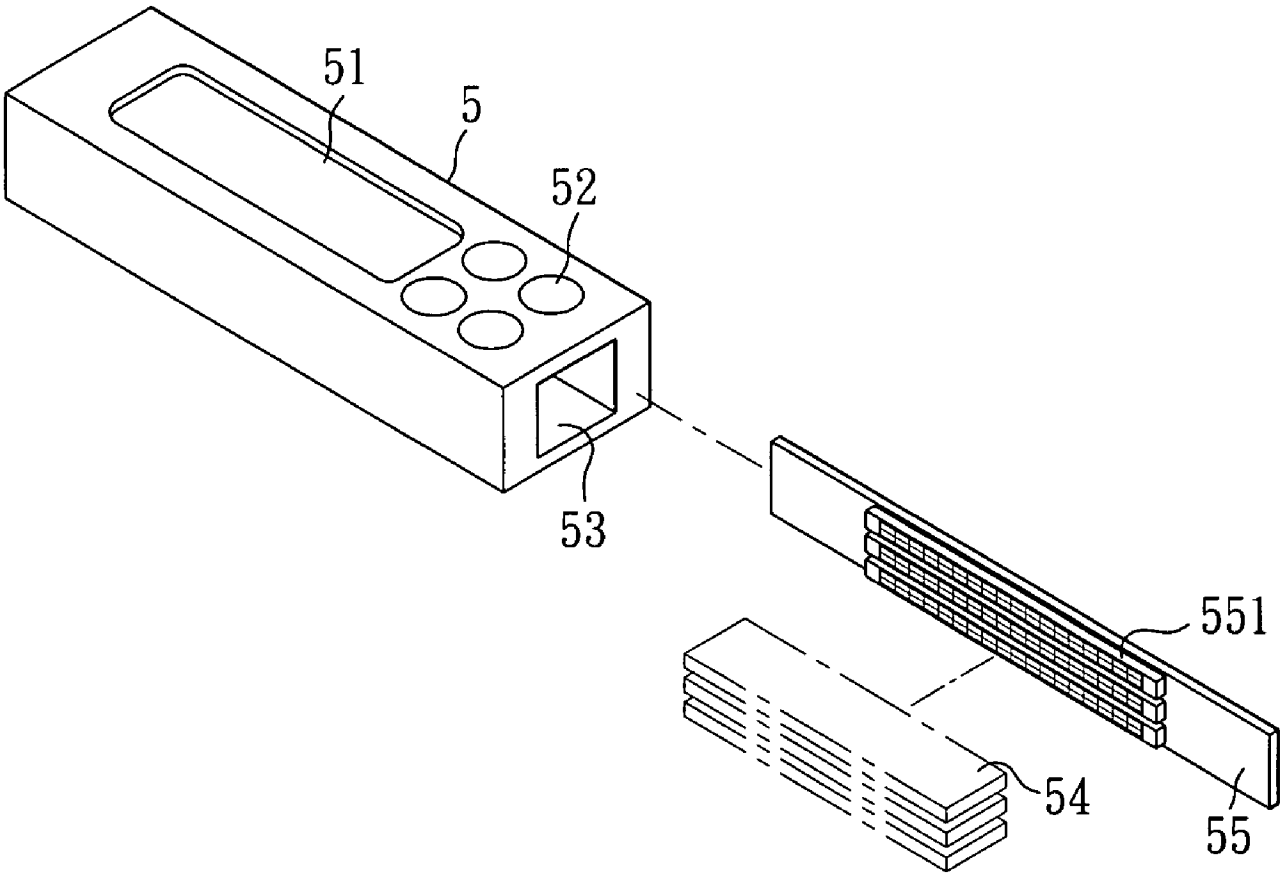
FIG. 4 is a schematic explode view of the third embodiment of the present invention.

FIG. 4 shows the third embodiment of the present invention, the volume 53 is positioned inside the electronic mechanism 5 for installing a substrate 55 and several electronic unit 54; the substrate 55 is a flat structure has several slots 551 that corresponding to the electronic units 54; the electronic units 54 insert in the slots 551 of the substrate 55 for connecting electronically to the electronic units 54 and the substrate 55 with parallel tiering. It is efficient to minimize the volume of the electronic mechanism 5.

Figure 5:
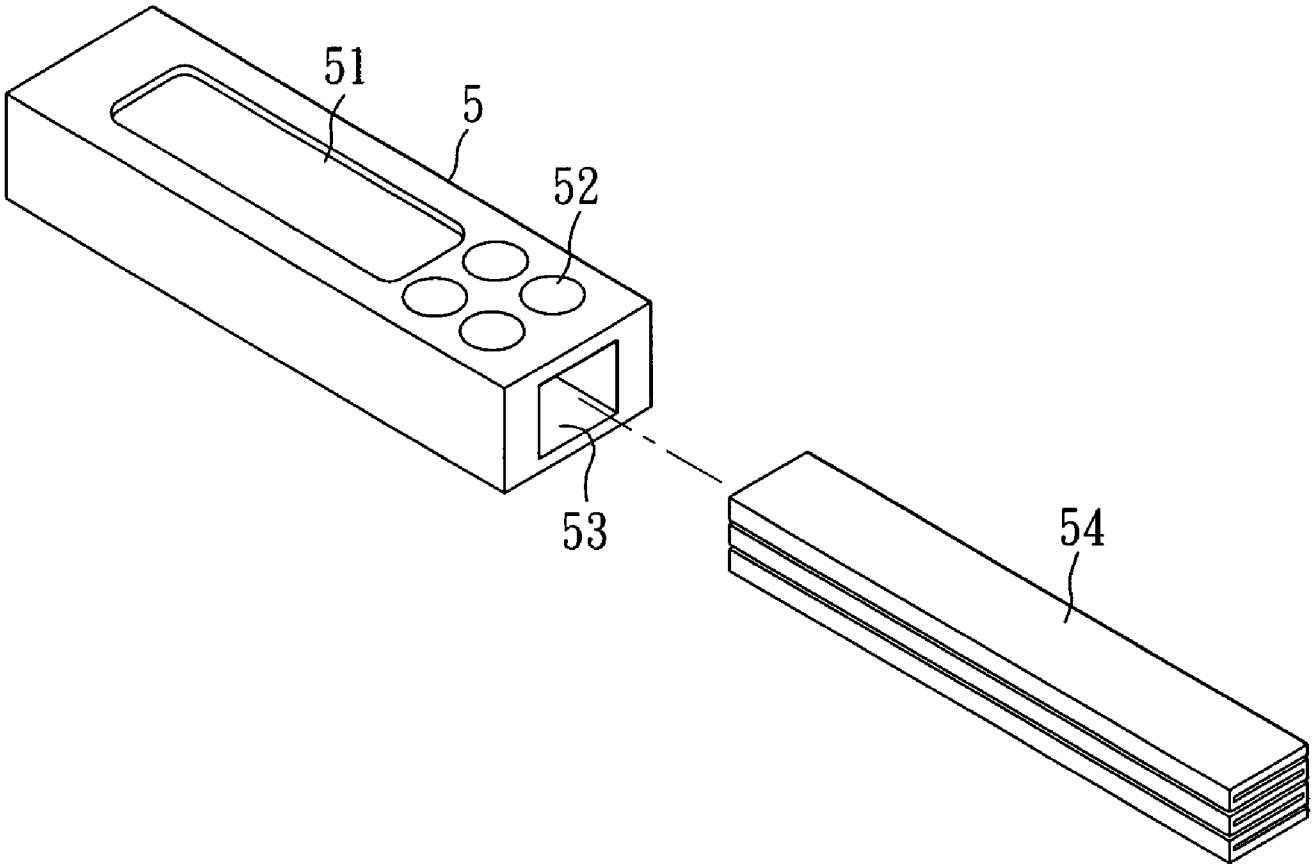
FIG. 5 is a schematic explode view of the fourth embodiment of the present invention.

FIG. 5 shows the fourth embodiment of the present invention, the volume 53 is positioned inside the electronic mechanism 5 for installing a electronic unit 54; the electronic unit 54 is a flexible substrate 55 with folding for six layers with tiering. So it is efficient to minimize the volume of the electronic mechanism 5.

Figure 6:
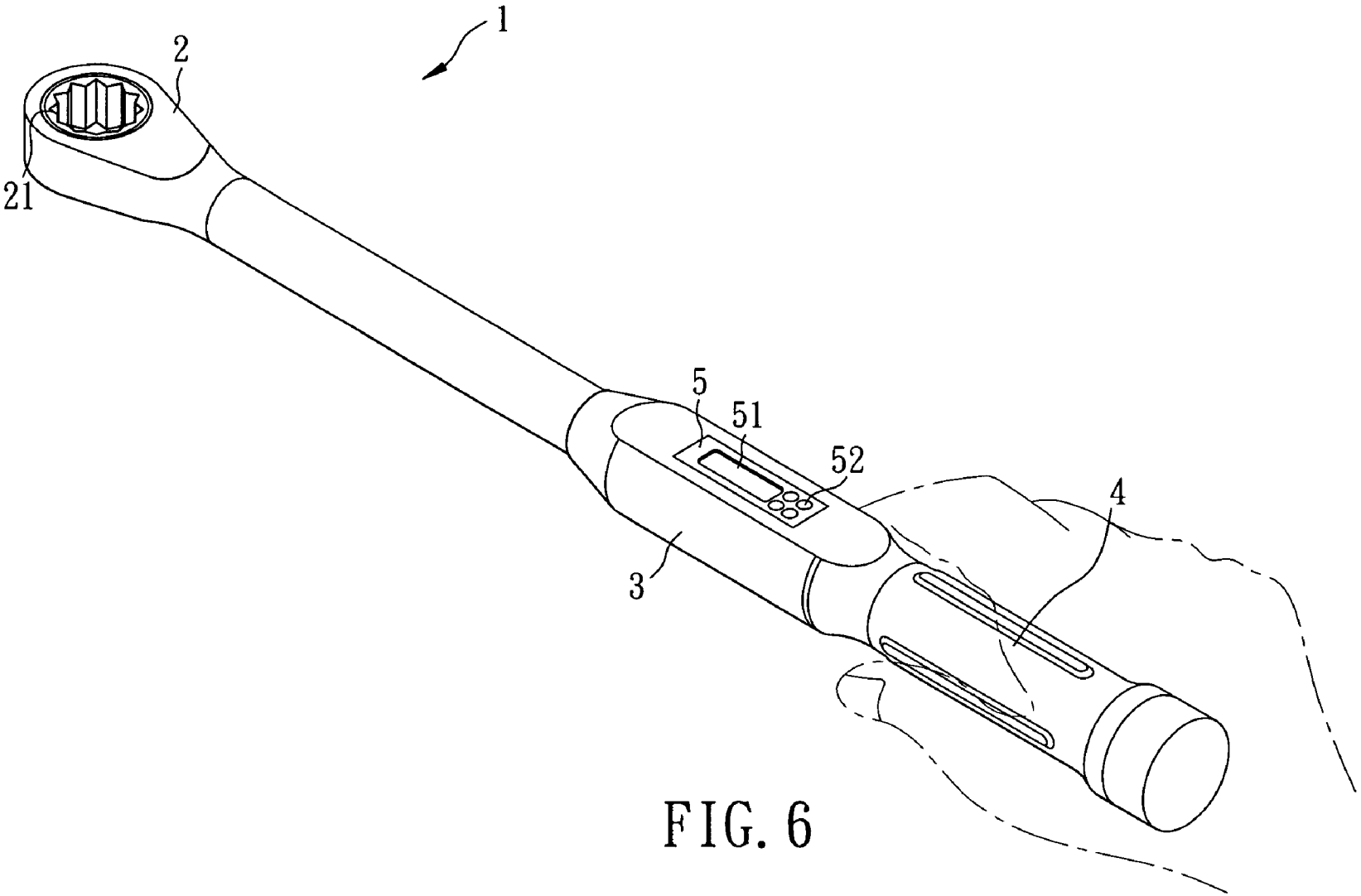
FIG. 6 shows the operation of the present invention.

As FIG. 6 shows, user can use the tool 1 just like other normal wrench, the electronic unit 54 inside the electronic mechanism 5 with tiering provides functions as a torque measurement, a temperature measurement, a humidity measurement, a horizontal angle measurement, a data memorization, a data transmitter, a alert, or a combination of them.

However, above mentioned embodiments are just examples of the present invention, they are not confined the scope of the present invention. The forms of the handle and head and the location of the slot may be varied as desired.

The present invention is thus described; it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multi-function digital tool, said tool comprising:

a body portion positioned between a handle portion and a driving portion, said driving portion having a driving head;

a space provided for installing a electronic mechanism inside said body portion; and a volume provided for installing at least two electronic units with tiering inside said electronic mechanism;

wherein the electronic units are PCBs (printed circuit boards);

wherein at least one of the electronic units is demountable and swappable.

2. The multi-function digital tool as claimed in claim 1, wherein the electronic units are connected each other by using pins.

3. The multi-function digital tool as claimed in claim 1, wherein a substrate is installed inside the electronic mechanism having a plurality of slots for connecting the electronic units each other.

4. The multi-function digital tool as claimed in claim 1, wherein the electronic units are connected each other by using bond wires.

5. The multi-function digital tool as claimed in claim 1, wherein a display unit is installed on the outer surface of the electronic mechanism.

6. The multi-function digital tool as claimed in claim 1, wherein a controlling unit is installed on the outer surface of the electronic mechanism.

7. The multi-function digital tool as claimed in claim 1, wherein the electronic mechanism functions as a torque measurement, a temperature measurement, a humidity measurement, a horizontal angle measurement, a data memorization, a data transmitter, a alert, or a combination of them.

* * * * *